US006109166A

United States Patent [19]

Granberg

[11] Patent Number: 6,109,166

[45] Date of Patent: Aug. 29, 2000

[54] FLUID PRESSURE CYLINDER

[75] Inventor: Rune Granberg, Älvajö , Sweden

[73] Assignee: AB Rexroth Mecman, Stockholm, Sweden

[21] Appl. No.: 09/181,937

[22] Filed: Oct. 28, 1998

[30] Foreign Application Priority Data

Oct. 31, 1997 [SE] Sweden ..... 9703995

[51] Int. Cl.[7] ..... F01B 29/00

[52] U.S. Cl. ..... 92/88

[58] Field of Search ..... 92/88, 128

[56] References Cited

U.S. PATENT DOCUMENTS

| | | | |
|---|---|---|---|
| Re. 33,637 | 7/1991 | Hoglund | 92/88 |
| 4,373,427 | 2/1983 | Garlapaty et al. . | |
| 4,519,297 | 5/1985 | Lipinski et al. | 92/88 |
| 4,519,397 | 5/1985 | Lipinski | 92/88 |
| 4,545,290 | 10/1985 | Lieberman | 92/88 |
| 4,555,980 | 12/1985 | Hoglund | 92/88 |
| 4,664,019 | 5/1987 | Lipinski et al. | 92/88 |
| 4,685,383 | 8/1987 | Ruchser | 92/88 |
| 4,724,744 | 2/1988 | Rosengren | 92/88 |
| 5,040,332 | 8/1991 | Aquilina | 92/88 X |
| 5,473,971 | 12/1995 | Takeuchi et al. | 92/88 |
| 5,988,042 | 11/1999 | Lamle | 92/88 |
| 6,007,247 | 12/1999 | Rosengren et al. | 92/88 X |

FOREIGN PATENT DOCUMENTS

WO 95/18322 7/1995 WIPO .

*Primary Examiner*—John E. Ryznic

*Attorney, Agent, or Firm*—Townsend & Townsend & Crew LLP

[57] ABSTRACT

Pressure fluid cylinder including a slot type cylinder tube which is shielded and sealed by an outer (11) and an inner (10) sealing band, a piston (2,5) which is arranged inside the tube and a transfer means (3) for transferring the movement of the piston to the outside of the cylinder tube. The invention is distinguished by the piston comprising a central body (2) and two piston end units (5) which surround the respective end thereof and support directly against the body, said units comprising guide elements (17) for the piston inside the cylinder, and by each piston end unit (5) comprising an integral piston sealing member seat (7).

11 Claims, 2 Drawing Sheets

FLUID PRESSURE CYLINDER

Figure 1:
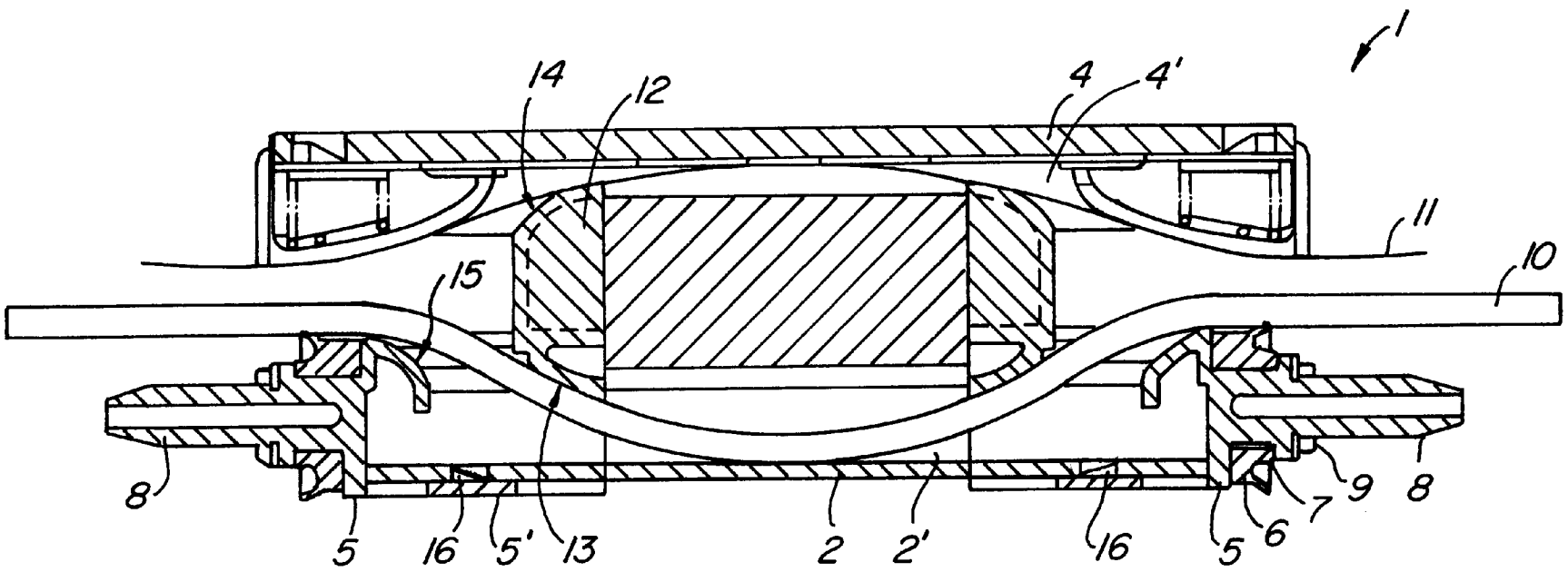

This invention concerns a fluid pressure cylinder according to the preamble of claim 1.

U.S. Pat. No. 4,555,980 (AB Mecman) discloses a fluid pressure cylinder of this kind, wherein the piston at each end portion on its body comprises a groove for receiving a collar type piston sealing member, and inside the seal, a guiding sleeve, preferably of polyamide so as to guide the piston movement inside the cylinder tube. The outer and the inner sealing band guides are comprised of guiding elements which are mounted separately on the piston body which in turn is connected to a separate shuttle carriage which is moveable on the outside of the cylinder tube.

The construction of the piston device of the disclosed fluid pressure cylinder is thus complicated and presupposes several machining operations and considerable assembly work to produce. All together this results in a fluid pressure cylinder which is costly to produce and therefore is relatively expensive.

In other previously known fluid pressure cylinders, the piston comprises piston end units which either are partly inserted into the tubular piston body or are attached to the axial outside of the body by separate connecting rods. These arrangements are complicated as well and also unsafe with respect to strength.

It is an aim of this invention to provide a development of the known art which does not suffer from the mentioned drawbacks and thus is possible to produce at a low cost, provides advantageous force reception and further is suitable for manufacture in large series.

This aim is obtained in a flow pressure cylinder of the above mentioned kind by the features of the characterizing portion of claim 1.

By thus each piston end unit surrounding an end of the piston body so that is comprises a guide element for the piston, several advantages are obtained. Firstly, the piston body may be manufactured essentially more rationally, since essential piston functions are provided by the piston end units. By these units in an integral manner including the piston guide elements and the seat for the sealing member, the process of manufacture is also simplified and, not least, essentially the assembly work, resulting in a fluid pressure cylinder which may be manufactured at essentially lower costs than before. At the same time a solution is provided which is advantageous from the aspects of force distribution and strength.

Claim 2 defines a construction of the seat for the piston seal member which is preferred with respect to manufacture.

The aspect of the invention according to claim 3, wherein the band guiding means are integral with the piston end units, result in further advantages with respect to manufacture. According to the known art these elements are made of separate parts which are mounted separately on the piston and on the transfer member respectively. By the present aspect, the number of elements included in the device may thus be radically reduced and the assembly work simplified. Claims 4 and 5 define preferred embodiments of the elements concerned.

The feature of claim 6 provides further advantages of the device in the case where the cushioning projection is arranged on the piston which further brings about the advantage that drawing of channels in the cylinder end walls may be made more simple and with less flow restrictions.

The feature according to claim 8 result in a preferred simplification of the piston construction, which is essentially accentuated by the feature in claim 9 which allows manufacture of the piston unit to be simplified so that the entire piston unit including the piston body, the transfer means and the shuttle superstructure is manufactured as a part of a profile body of extruded aluminium, preferably, or an aluminium alloy. Machining of the profile body is essentially limited to cutting and a few machining operations in order to achieve access to passage channels for the sealing bands.

The feature in claims 10 and in 11 assure further simplified assembly and safe fastening.

Figure 3:
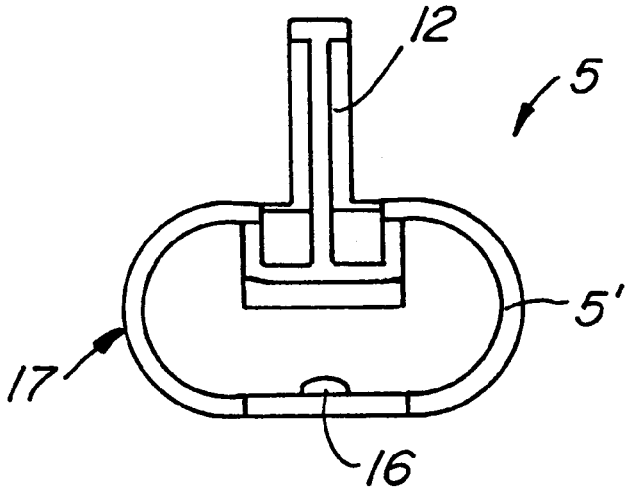
Figure 2:
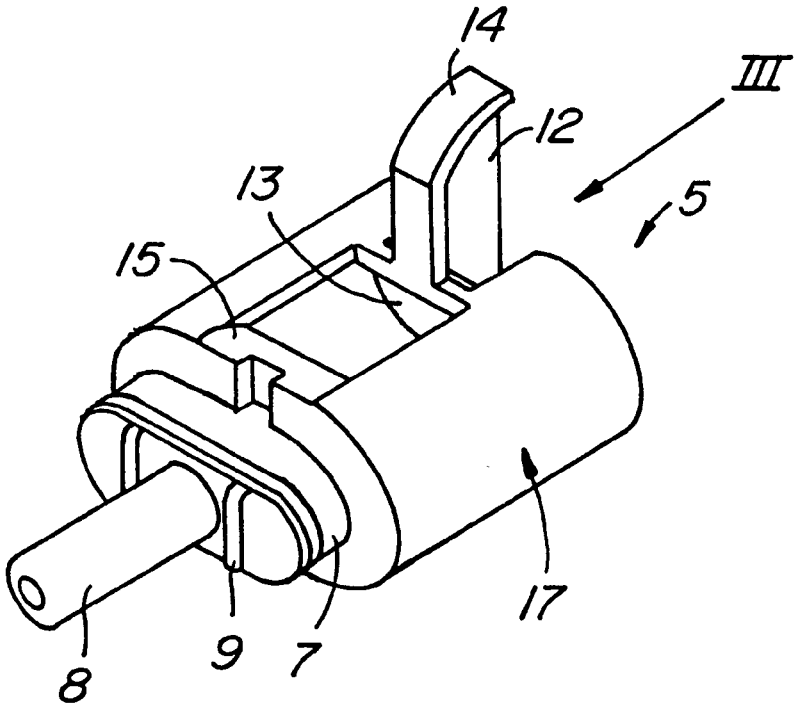

The invention will now be described in more detail at the background of an embodiment and with reference to the annexed drawings, wherein:

FIG. 1 shows a section through a piston unit according to the invention with mounted piston end units, FIG. 2 shows a piston end unit according to the invention in a perspective view, and FIG. 3 shows the piston end unit of FIG. 2 in an end view as seen in the direction of arrow III.

In FIG. 1, 1 indicates a piston unit including an essentially tubular piston body 2 a transfer means 3 for penetration through the cylinder slot and a shuttle superstructure 4. A piston end unit 5 is fitted on each axially most outward end part of the piston body and is comprising a partially sleeve-shaped portion 5' (is more clear on FIG. 2) for surrounding a respective piston body end, and further, axially in the direction from said portion 5', a projecting part having radially reduced dimensions which forms a seat 7 for a piston sealing member 6. Most outwardly on the unit 5 there is provided a cushioning projection 8 for cushioning co-operation with a corresponding recess in the cylinder end wall and, sideways with respect to the cushioning projection 8, buffer devices 9 for cushioning the strike against the cylinder end wall.

10 indicates an inner sealing band which is not shown in detail, and 11 an outer sealing band which both may be of a conventional type. The sealing bands 10 and 11 run in a channel 2' in the piston body and in a channel 4' in the shuttle super-structure respectively. In the shown embodiment, the piston end unit 5 carries a band guiding element 12 which on the one hand comprises an inner guiding surface 13 for co-operation with the upper surface of the inner sealing band, on the other hand an outer guiding surface 14 on a guiding tongue extending through the cylinder slot (illustrated in more detail on FIG. 2) for the co-operation with the outer sealing band 11. Further, the shuttle superstructure 4 is provided with depression means 20 which may be of a conventional kind for the co-operation with the upper side of the outer sealing band 11.

FIG. 1 further shows a snap lock means 16 on each piston end unit, said means comprising an inclined entering surface, tapering against the direction of fitting on to the piston body 2 and said means being arranged to co-operate with a corresponding recess in a surface of the piston body.

The perspective view of FIG. 2 illustrate the piston end unit 5, which in this case is intended for a piston having an oblong transverse section, with its integral functions, namely the guide surface 17 which is adapted to guide the piston aggregate inside the cylinder tube, the axially extending part forming the seat 7 of a sealing member, the axially most outwardly positioned cushioning projection 8 and the sideways positioned buffer devices 9 which may be separate elements inserted into recesses in the piston end unit or integral parts, possibly from another, preferably softer, material. Further, the guiding tongue is illustrated which forms the outer part of the band guiding element 12 and the guiding surface 14 provided thereon, the inner guiding surface 13 and the lower guiding surface 15.

The end view of FIG. 3 more clearly illustrates the sleeve-shape 5', with the surface 17. It should be noted that the hollow shape, which is most clearly illustrated in FIG. 3, brings about that a piston body being inserted without play into the end unit and being positioned inside the sleeve portion, will receive good guidance at its movement inside the cylinder tube. The snap lock means 16 is shown as an inwardly directed inclined pin being positioned centrally on the lower inner surface.

The invention may be modified within the scope of the annexed claims, whereby also cylinders having piston end units without band guides or cushioning projections are included in the protection, although it is highly preferred that such elements are integrated into the unit. The fastening means for the piston end units may be constructed differently than what is shown, for example with snap lock means placed on other places, with grooves and ridges coming into engagement with each other etc. Also separate pins may be used.

The form of the respective parts may be modified, for example such that the piston body is reverse U-shaped in section instead of being tubular.

Materials suitable for the piston end unit are synthetic materials and the methods of production may be conventional for plastic materials.

What is claimed is:

1. Pressure fluid cylinder of the kind including a slot type cylinder tube which is shielded and sealed by an outer (11) and an inner (10) sealing band, a piston (2,5) which is arranged moveable inside the tube and a transfer means (3) for transferring the movement of the piston through the slot to the outside of the cylinder tube, whereby the piston on each piston end comprises on the one hand a seat (7) for a piston sealing member (6) and on the other hand upper (14) and lower (13,15) guide means for co-operation with said outer and inner sealing bands, characterized in that the piston comprises a central body (2) and two piston end units (5) which surround the respective end thereof and support directly against the body, said units comprising guide elements (17) for the piston inside the cylinder, and that each piston end unit (5) comprises an integral piston sealing member seat (7).

2. Cylinder according to claim 1, characterized in that the seat (7) for the piston sealing member (6) is comprised of a groove on an axially extending portion having reduced dimensions in radial directions.

3. Cylinder according to claim 1, characterized in that each piston end unit (5) includes integral upper and lower guiding elements (13,14,15) for the sealing bands (10,11).

4. Cylinder according to claim 3, characterized in that the guide for the inner band (10) is comprised of two rounded guiding surfaces (13,15), each being arranged to cooperate with one side of said band.

5. Cylinder according to claim 3, characterized in that the guide for the outer band (11) is comprised of a guiding surface (14) on a guiding tongue (12) which is adapted for penetrating the cylinder slot.

6. Cylinder according to claim 1, characterized in that each piston end unit (5) comprises an integral cushioning projection (8).

7. Cylinder according to claim 1, characterized in that the piston end unit (5) is produced from a synthetic material.

8. Cylinder according to claim 1, characterized in that the piston body (2), the transfer means (3) and a fastening portion in the form of a shuttle superstructure (4) being moveable on the outside of the cylinder, together form an integral piston unit.

9. Cylinder according to claim 8, characterized in that the piston unit is comprised of an extruded profile body.

10. Cylinder according to claim 1, characterized in that the piston end unit (5) comprises a snap lock means (16) which is adapted to co-operate fixingly with snap lock recess means in the piston body (2) for locking the piston end unit thereto.

11. Cylinder according to claim 1, characterized in that the piston end unit (5) is guided against rotation relative to the piston body by means of an element carrying an inner guiding surface (15) for the inner sealing band (10).

* * * * *